US010327548B2

(12) United States Patent
Meusburger

(10) Patent No.: US 10,327,548 B2
(45) Date of Patent: Jun. 25, 2019

(54) DRAWER PULL-OUT GUIDE

(71) Applicant: Julius Blum GmbH, Hoechst (AT)

(72) Inventor: Marc Meusburger, Egg (AT)

(73) Assignee: JULIUS BLUM GMBH, Hoechst (AT)

( * ) Notice: Subject to any disclaimer, the term of this patent is extended or adjusted under 35 U.S.C. 154(b) by 0 days.

(21) Appl. No.: 16/018,314

(22) Filed: Jun. 26, 2018

(65) Prior Publication Data

US 2018/0295991 A1 Oct. 18, 2018

Related U.S. Application Data

(63) Continuation of application No. PCT/AT2016/060122, filed on Dec. 12, 2016.

(30) Foreign Application Priority Data

Jan. 13, 2016 (AT) ..... A 50012/2016

(51) Int. Cl.
*A47B 88/00* (2017.01)
*A47B 88/477* (2017.01)
(Continued)

(52) U.S. Cl.
CPC ..... *A47B 88/477* (2017.01); *A47B 88/437* (2017.01); *A47B 88/473* (2017.01);
(Continued)

(58) Field of Classification Search
CPC ..... A47B 88/57; A47B 2210/0018; A47B 2210/0094; A47B 2210/0097
See application file for complete search history.

(56) References Cited

U.S. PATENT DOCUMENTS 6,015,199 A * 1/2000 Netzer ..... A47B 88/493 312/334.46
7,758,135 B2 7/2010 Lam et al.
(Continued)

FOREIGN PATENT DOCUMENTS

AT 6775 4/2004
CN 202681157 1/2013
(Continued)

OTHER PUBLICATIONS

Search Report dated Oct. 14, 2016 in Austrian Application No. A 50012/2016, with English translation.
(Continued)

*Primary Examiner* — Matthew W Ing
(74) *Attorney, Agent, or Firm* — Wenderoth, Lind & Ponack, L.L.P.

(57) ABSTRACT

A drawer pull-out guide includes a first rail and a second rail displaceable relative to one another, and a running carriage with a rolling body. The running carriage is displaceably arranged between the first rail and the second rail over a travelling path. A limiting element is arranged on the first rail or on the second rail, and the limiting element limits the travelling path of the running carriage. A damping device is arranged on the running carriage for dampening a movement of the running carriage over a damping path when the running carriage abuts against the limiting element. At the end of a maximum damping path of the running carriage, a stop of the first rail and a counterstop of the second rail abut against each other and thereby stop a movement of the second rail relative to the first rail.

14 Claims, 4 Drawing Sheets

(51) Int. Cl.

| | |
|---|---|
| ***A47B 88/437*** | (2017.01) |
| ***A47B 88/473*** | (2017.01) |
| ***A47B 88/487*** | (2017.01) |
| *A47B 88/493* | (2017.01) |
| *A47B 88/447* | (2017.01) |

(52) U.S. Cl.

CPC ..... *A47B 88/487* (2017.01); *A47B 88/447* (2017.01); *A47B 88/493* (2017.01); *A47B 2210/004* (2013.01); *A47B 2210/007* (2013.01); *A47B 2210/0013* (2013.01); *A47B 2210/0059* (2013.01); *A47B 2210/0081* (2013.01); *A47B 2210/0097* (2013.01)

(56) References Cited

U.S. PATENT DOCUMENTS

| | | | | |
|---|---|---|---|---|
| 7,762,637 | B2 | 7/2010 | Lam et al. | |
| 8,376,481 | B2 * | 2/2013 | Lee | F25D 25/025 312/331 |
| 9,784,314 | B2 | 10/2017 | Ng | |
| 2004/0222723 | A1 * | 11/2004 | Fitz | A47B 88/467 312/334.6 |
| 2004/0227444 | A1 * | 11/2004 | Booker | F16F 9/0218 312/334.45 |
| 2006/0091771 | A1 * | 5/2006 | Teskey | A47B 88/49 312/334.44 |
| 2007/0080616 | A1 * | 4/2007 | Lam | A47B 88/49 312/334.6 |
| 2009/0278432 | A1 | 11/2009 | Lam et al. | |
| 2010/0045153 | A1 * | 2/2010 | Ritter | A47B 88/487 312/334.1 |
| 2010/0244643 | A1 * | 9/2010 | Chiang | A47B 88/483 312/334.44 |
| 2014/0009054 | A1 * | 1/2014 | Salice | A47B 88/57 312/334.44 |
| 2014/0241651 | A1 * | 8/2014 | Greussing | A47B 88/487 384/19 |
| 2016/0128472 | A1 * | 5/2016 | Ng | F16C 29/005 384/18 |
| 2017/0135482 | A1 * | 5/2017 | Chen | A47B 88/493 |

FOREIGN PATENT DOCUMENTS

| | | |
|---|---|---|
| DE | 20 2005 014 127 | 11/2005 |
| DE | 10 2005 019 341 | 2/2006 |
| EP | 0 868 866 | 10/1998 |
| EP | 1 475 014 | 11/2004 |
| EP | 1 774 870 | 4/2007 |
| ES | 1 148 059 | 12/2015 |

OTHER PUBLICATIONS

International Search Report dated Feb. 24, 2017 in International (PCT) Application No. PCT/AT2016/060122.

* cited by examiner

DRAWER PULL-OUT GUIDE

BACKGROUND OF THE INVENTION

The present invention relates to a drawer pull-out guide, including a first rail and at least one second rail which are displaceable relative to one another, and at least one running carriage with at least one rolling body, in which the running carriage is displaceably arranged between the first rail and the second rail over a travelling path. At least one limiting element is arranged on the first rail or on the second rail, and the limiting element limits the travelling path of the running carriage. A damping device is arranged on the running carriage for dampening a movement of the running carriage over a damping path when the running carriage abuts against the limiting element, and a maximum damping path of the damping device is predetermined.

The invention further concerns an item of furniture with a furniture carcass and with a drawer displaceably arranged relative to the furniture carcass by a pull-out guide of the type to be described.

EP 0 868 866 B1 shows a drawer pull-out guide having a carcass rail and a movably-mounted extension rail, in which a running carriage with load-transmitting rolling bodies is displaceably arranged between the carcass rail and the extension rail. Provided on the rails are stops for limiting the travelling path of the running carriage in the longitudinal direction of the rails. The running carriages, on their frontal faces, have spring buffers for dampening an impact of the running carriage on the stops in the end positions of the running carriage.

DE 20 2005 014 127 U1 shows a further pull-out guide, in which a cage for accommodating rolling bodies is displaceably arranged between the carcass rail and the drawer rail. The cage for accommodating the rolling bodies is configured so as to be resilient in a direction of its longitudinal axis by the arrangement of slits, so that the running carriage, when hitting against a stop arranged on the carcass rail, can be decelerated in a noise-absorbing manner.

The disadvantage of the above configuration is that the kinetic energy is absorbed almost exclusively by the running carriages when reaching the respective end positions of the extension rail, whereby the running carriages are subjected to considerable strains. These strains can lead to deformations or even to a breakage of the running carriages, in particular when the running carriages, for the reason of a compact design, are formed of plastic having a thin wall thickness. An additional strain of the running carriages occurs when the drawer pull-out guide has a short nominal length, because the extension rail, right after opening, frequently reaches the fully extended position with great momentum and thereby also the spring buffers of the running carriage hit the stops of the rails in a forceful manner. Also in a case of improper use, in which the drawer is being catapulted into the closed position or open position by an excessive manual force, considerable forces act on the running carriage, so that there is the danger of damage of the running carriage.

DE 10 2005 019 341 A1 shows, in the embodiment of FIGS. 15-19, a drawer pull-out guide in which stops are provided both on the carcass rail and the drawer rail. The stops abut against each other when the drawer rail reaches a maximum extension movement, and a further extension movement is thereby prevented.

It is an object of the present invention to propose a drawer pull-out guide mentioned in the introductory part, wherein the danger of a damage of the running carriage is reduced.

SUMMARY OF THE INVENTION

According to the invention, a stop is arranged on the first rail and a counterstop is arranged on the second rail. At the end of the maximum damping path of the running carriage, the stop of the first rail and the counterstop of the second rail abut against each other and thereby stop a movement of the second rail relative to the first rail.

The present invention is thus based on the concept that the running carriage, when abutting the limiting element, is initially dampened over the predetermined maximum damping path of the damping device. When a predetermined force acting on the running carriage is exceeded, the stop and the counterstop abut against each other and stop a further movement of the rails, so that a further force acting on the running carriage is prevented.

In this way, the excessive forces are absorbed by the rails of the drawer pull-out guide, so that the running carriage remains unaffected by these additional forces. The running carriage, after the damping hub has been effected, is thus not subjected to additional strains which could lead to a deformation or to a breakage.

The damping device can be arranged on a frontal end of the running carriage, wherein the damping device, according to a first embodiment, can include at least one spring tongue arranged on the running carriage. The spring tongue, when the running carriage abuts the limiting element, is configured so as to be reversibly bendable or reversibly deformable against a resilient action of the spring tongue. The maximum damping path is thus predetermined by a maximum compression path of the spring tongue. Without the spring tongue, the running carriage or a further component is damaged.

According to a further embodiment, the damping device of the running carriage includes a fluid damper, for example with a piston-cylinder-unit, as shown and described in EP 1 475 014 B1. The maximum damping path, in this case, is predetermined by the maximum admissible damping hub of the piston-cylinder-unit.

Because of the fact that the closing movement of an extendable rail of the drawer pull-out guide is frequently decelerated by a self-closing retraction device having a damping function, a stop member of the rails, in the closed position of the drawer pull-out guide, is not necessarily required. Thus, it can be sufficient when the first rail and the second rail are displaceably arranged between a closed position and an open position, and the stop of the first rail and the counterstop of the second rail abut against each other in the open position and therewith prevent a further extension movement of the second rail towards the opening direction.

A first embodiment of an inventive item of furniture is characterized in that the item of furniture has a furniture carcass and a drawer displaceably arranged relative to the furniture carcass by a drawer pull-out guide of the type described. The first rail is configured as a carcass rail to be fixed to a furniture carcass, and the second rail is a drawer rail fixed to the drawer. The running carriage is displaceably arranged between the carcass rail and the drawer rail.

A second embodiment of an inventive item of furniture is characterized in that the item of furniture has a furniture carcass and a drawer displaceably arranged relative to the furniture carcass by a drawer pull-out guide of the type described. The first rail is a carcass rail fixed to the furniture carcass, and the second rail is a central rail displaceably arranged between the carcass rail and a drawer rail fixed to the drawer, and the running carriage is displaceably arranged between the carcass rail and the central rail.

A third embodiment of an inventive item of furniture is characterized in that the item of furniture has a furniture carcass and a drawer displaceably arranged relative to the furniture carcass by a drawer pull-out guide of the type described. The second rail is a drawer rail fixed to the drawer and the first rail is a central rail displaceably arranged between a carcass rail fixed to the furniture carcass and the drawer rail, and the running carriage is displaceably arranged between the central rail and the drawer rail.

BRIEF DESCRIPTION OF THE DRAWINGS

Further details and advantages of the present invention will be explained with the aid of the following description of figures, in which.

DETAILED DESCRIPTION OF THE INVENTION

Figure 1:
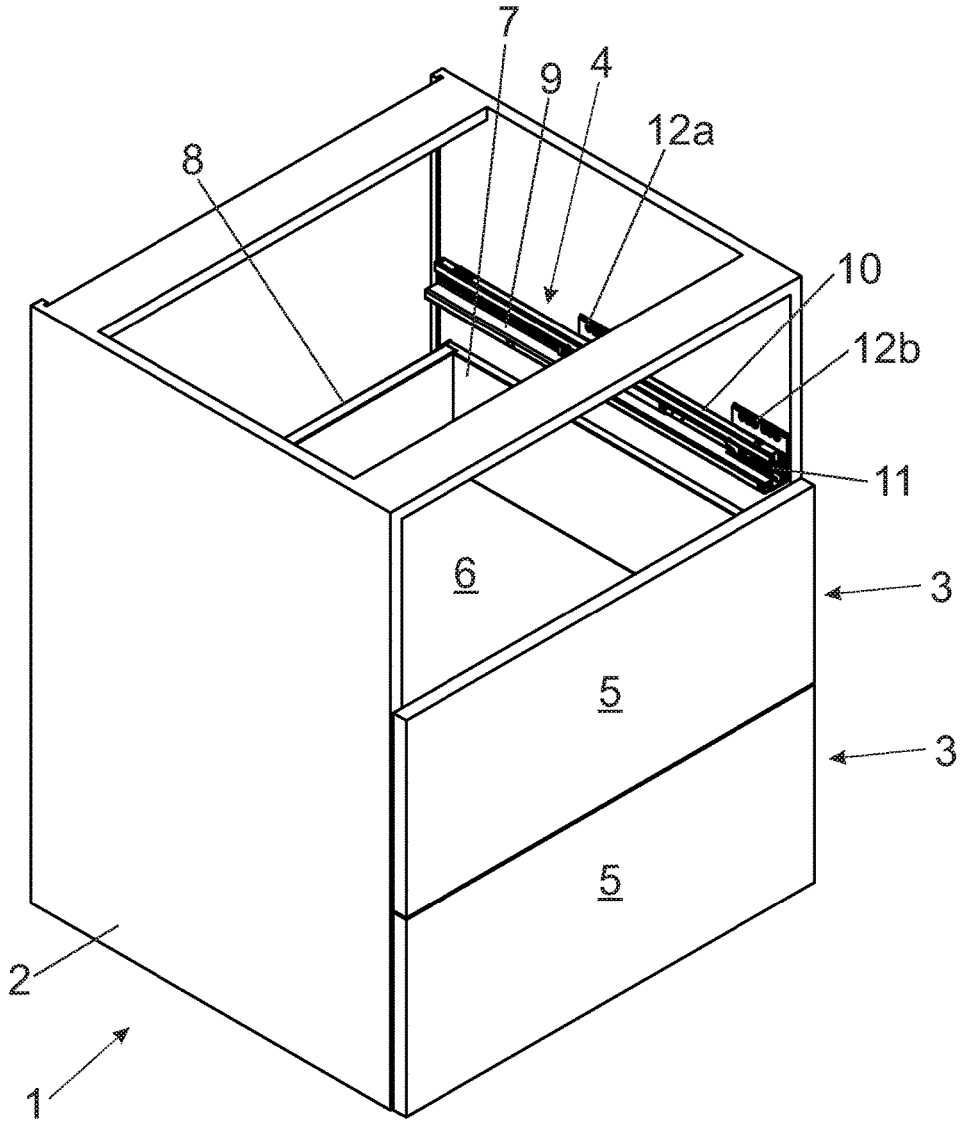
FIG. 1 is a perspective view of an item of furniture with a furniture carcass and drawers displaceably mounted thereto.

FIG. 1 shows an item of furniture 1 with a cupboard-shaped furniture carcass 2, wherein drawers 3 are displaceably arranged relative to the furniture carcass 2 by drawer pull-out guides 4. The drawers 3 each have a front panel 5, a drawer bottom 6, drawer side walls 7 and a rear wall 8. The drawer pull-out guides 4 each have a rail 9 (carcass rail) to be stationarily fixed to the furniture carcass 2 by fastening portions 12*a*, 12*b*, a second rail 10 (drawer rail) which is displaceably arranged relative to the carcass rail 9 and which is connected or which is adapted to be connected to the drawer side wall 7, and a first rail 11 (central rail) displaceably arranged between the rail 9 and the second rail 10 so as to allow the drawer 3 to be fully extended. In the present description, for the sake of simplicity, the central rail is denoted as the first rail 11 and the drawer rail is denoted as the second rail 10. Naturally, it is also clear that the carcass rail 9 can be seen as the first rail and the central rail as the second rail.

Figure 2A:
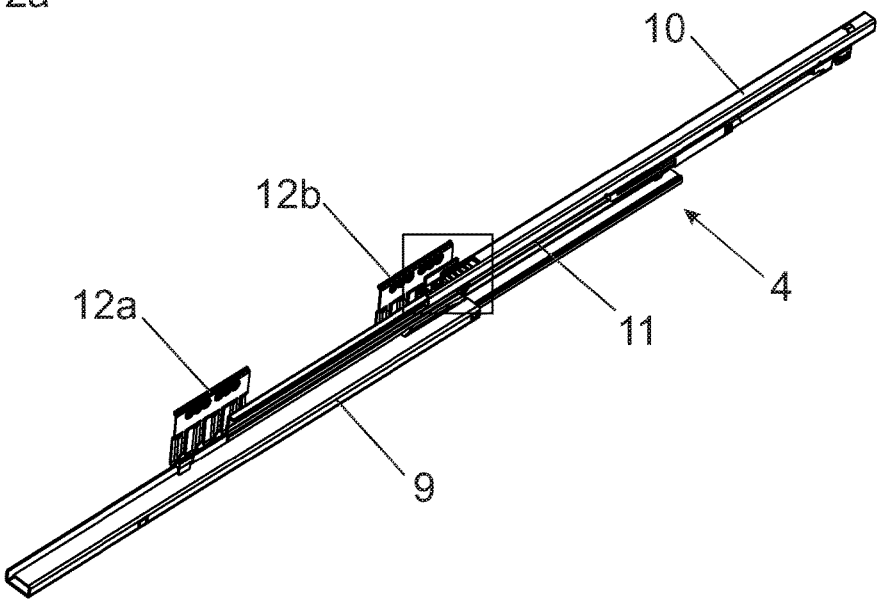
FIG. 2*a*, 2*b* is a partially broken away perspective view of the drawer pull-out guide and an enlarged detail view thereof.

FIG. 2*a* shows a partially broken away view of drawer pull-out guide 4 in an open position, with the rail 9 (carcass rail) to be fixed to the furniture carcass 2, wherein a first rail 11 (central rail) is displaceably arranged between the rail 9 and the second rail 10 for enlarging the extension movement of the drawer 3. Connected to the rail 9 are fastening portions 12*a*, 12*b* by which the drawer pull-out guide 4 can be mounted to the furniture carcass 2.

Figure 2B:
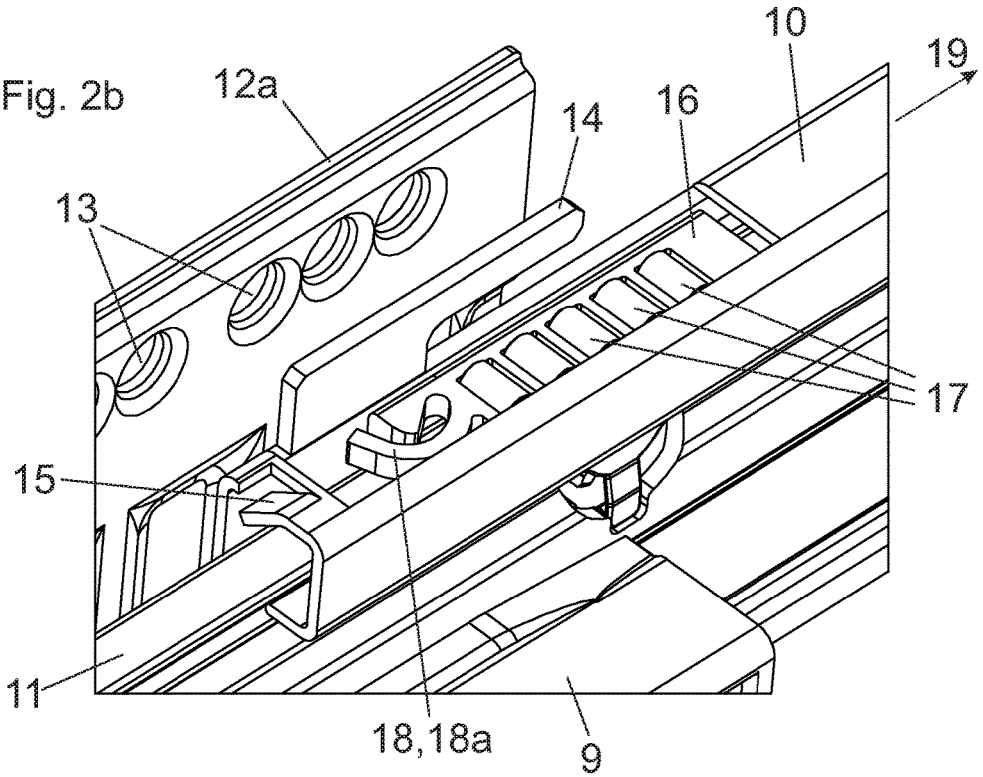

FIG. 2*b* shows the region framed in FIG. 2*a* in an enlarged view. The fastening portion 12*a* has a plurality of holes 13 for the passage of screws by which fastening to the furniture carcass 2 is effected. The second rail 10 is depicted partially broken away so that the running carriage 16 with the rolling bodies 17 arranged therein is visible. Arranged on a frontal end of the running carriage 16 is a damping device 18 which, in the shown embodiment, is configured as a spring buffer having at least one spring tongue 18*a*. Preferably, the spring tongue 18*a*, together with the running carriage 16, has a one-piece configuration formed by a molded plastic portion. Arranged on a rear end region of the second rail 10 is a limiting element 15 for limiting a travelling path of the running carriage 16 in the extension direction 19. In the shown figure, the limiting element 15, together with the second rail 10, has a one-piece configuration and can be formed by a tab bent away from the second rail 10. The spring tongue 18*a* is configured so as to be reversibly bendable or reversibly deformable against a resilient action of the spring tongue 18*a* when the running carriage 16 abuts against the limiting element 15 and thereby dampens an impact of the running carriage 16 when hitting against the limiting element 15. Instead of one or a plurality of spring tongues 18*a*, the damping device 18 can also be configured as a linear damper, for example with a piston-cylinder-unit, arranged in or on the running carriage 16. Arranged on the rear end of the second rail 10 is a pin 14 which is spaced from an upper side of the second rail 10 and which extends in a horizontal and in a longitudinal direction of the second rail 10. The pin 14, in the mounted position, engages into a bore arranged in the rear wall 8 (see FIG. 1) and thereby prevents an undesired change in position of the rear end region of the drawer 2 relative to the second rail 10.

Figure 3A:
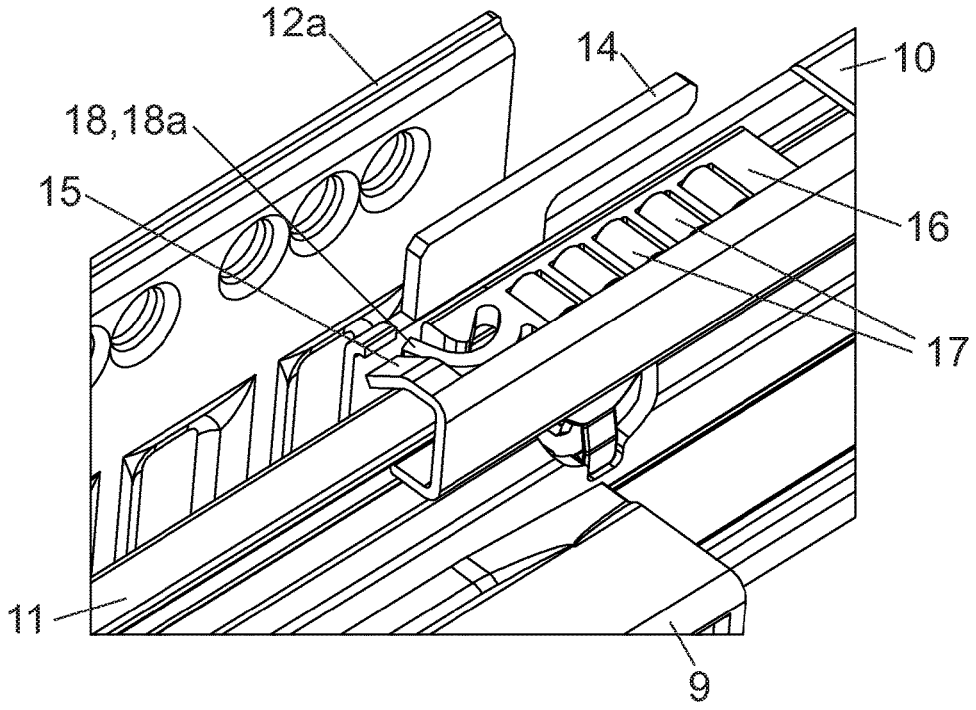
FIG. 3*a*, 3*b* show continued extension movements of the second rail with a running carriage abutting the limiting element.
Figure 3B:
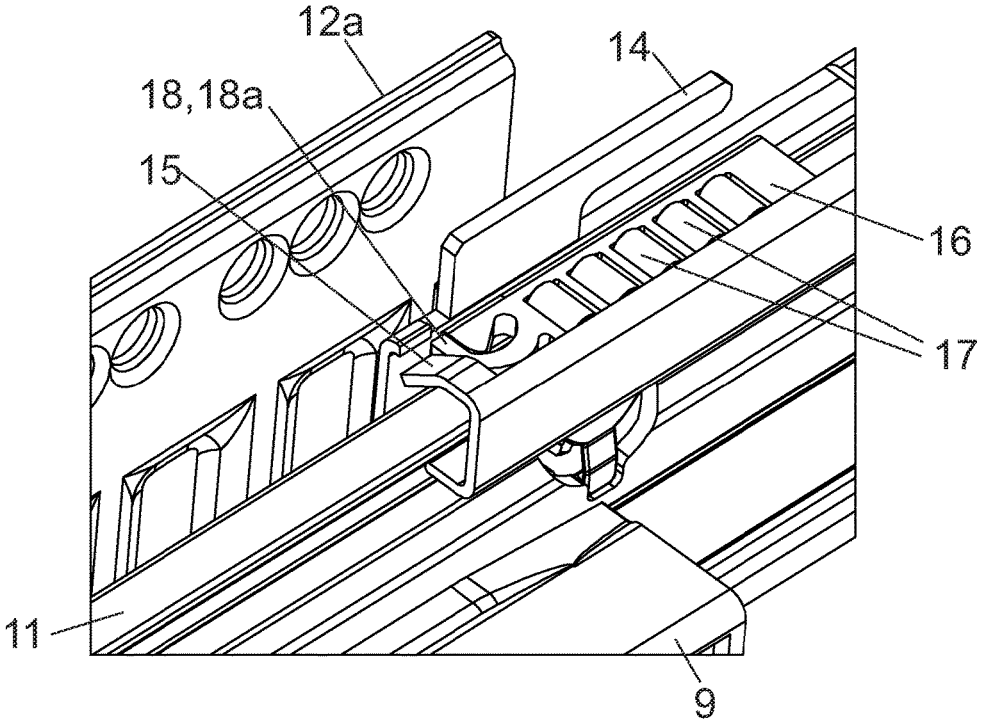

FIG. 3*a* shows, in relation to FIG. 2*b*, a continued movement of the second rail 10 in the extension direction 19, in which the spring tongue 18*a* of the damping device 18 abuts against the limiting element 15. In FIG. 3*b*, the maximum damping path 23 (see FIG. 4*b*) of the damping device 18 has been reached, and the free end of the spring tongue 18*a* abuts against the limiting element 15 and is therewith maximally deformed or bent. In this position of the running carriage 16, a stop 20 of the second rail 10 and a counterstop 21 of the first rail 11 abut against each other and stop a movement of the second rail 10 relative to the first rail 11, as shown and described in the following figures (of course, the names "stop" and "counterstop" are interchangeable such that the first rail 11 can be identified as having a "stop" 21, while the second rail 10 has a "counterstop" 20).

Figure 4A:
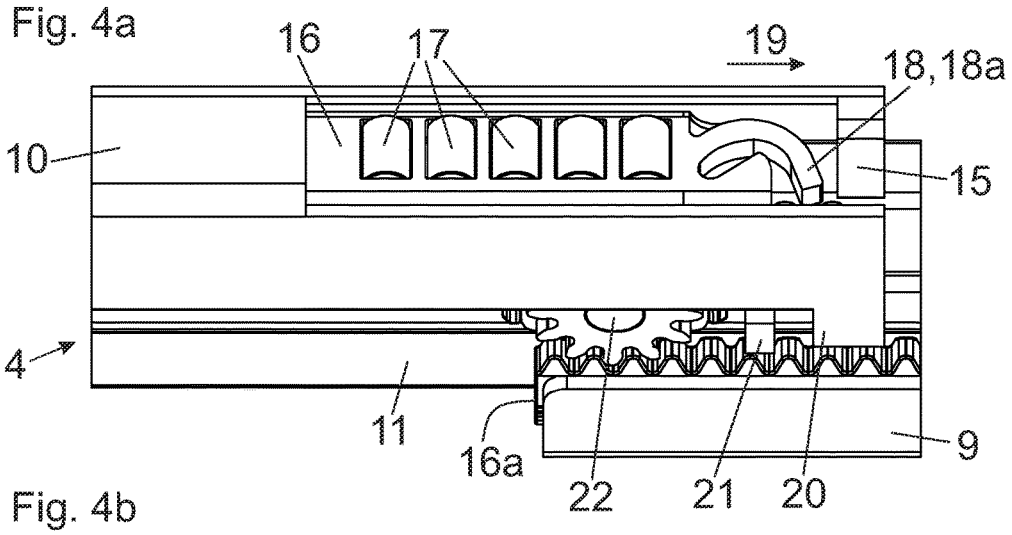
FIG. 4*a*-4*c* show the cooperation of the damping device with the limiting element and the cooperation of the stop with the counterstop in temporal sequences.
Figure 4B:
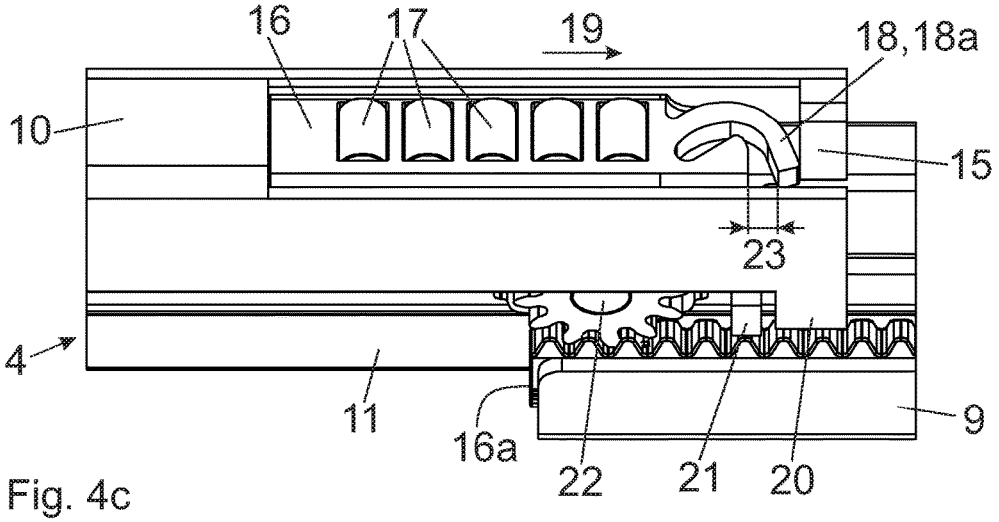
Figure 4C:
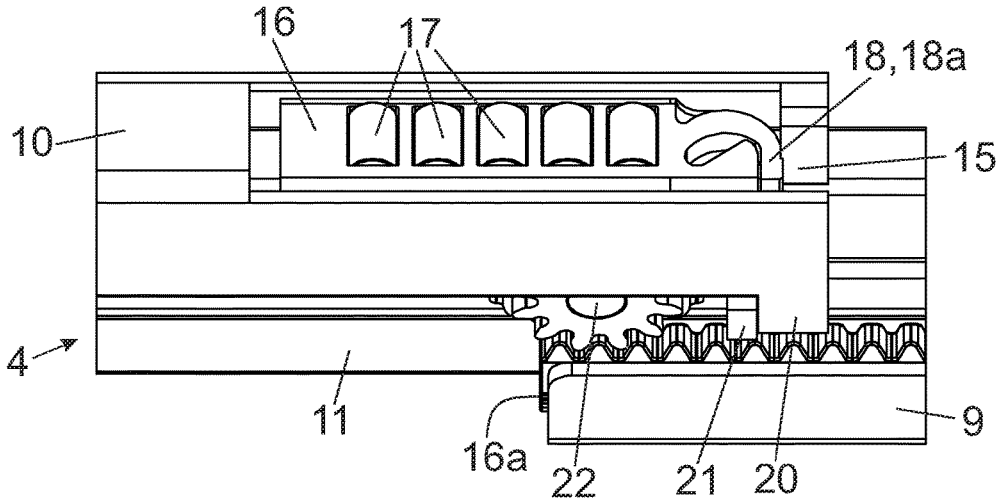

FIG. 4*a*-4*c* show the cooperation of the damping device 18 of the running carriage 16 with the limiting element 15 of the second rail 10 as well as the cooperation of the stop 20 of the second rail 10 with the counterstop 21 of the first rail 11 in temporal sequences. The limiting element 15 and the stop 20 are firmly connected to the second rail 10, while the counterstop 21 is firmly connected to the first rail 11. The second rail 10 is moved in the extension direction 19 until the spring tongue 18*a* of the damping device 18 arranged on the running carriage 16 abuts against the limiting element 15 of the second rail 10 (see FIG. 4*b*). At this point, the stop 20 protruding transversely from the second rail 10 and the counterstop 21 protruding transversely from the first rail 11 are still spaced from each other. By bending or by deforming the spring tongue 18*a*, a movement of the running carriage 16 can be dampened over a predetermined damping path 23, namely as long as the free end of the spring tongue 18*a* is maximally deformed or bent until abutting against another portion of the running carriage 16. When the maximum damping hub of the damping device 18 has been reached (i.e., at a position corresponding to the end of the maximum damping path 23 of the running carriage 16), the stop 20 of the second rail 10 and the counterstop 21 of the first rail 11 abut against each other (see FIG. 4*c*) and thereby prevent a further movement of the second rail 10 relative to the first rail 11. By the cooperation of the stop 20 with the counterstop 21, the running carriage 16 is relieved from additional forces, so that the danger of an undesired deformation or a breakage of the running carriage 16 is prevented. The cooperation of the spring tongue 18*a* with the limiting element 15 and the cooperation of the stop 20 with the counterstop 21 cause two different sounds perceptible by a person. The stop for the rails, formed by the stop 20 and the counterstop 21, is namely configured so as to be harder than the stop for the running carriage 16, formed by the damping device 18 and the limiting element 15. For example, this can be realized such that the stop 20 and the counterstop 21 are each formed by a metallic material and thereby cause an acustically hard warning sound. Accordingly, the majority of the energy is dissipated by these "hard stops" and not by the running carriage 16.

The drawer pull-out guide 4 further includes a forced control device 22 for controlling a movement of the running carriage 16 relative to a further (second) running carriage 16*a* which is displaceably arranged between the rail 9 to be fixed to the furniture carcass 2 and the first rail 11, and/or for controlling at least a movement of the running carriage 16 relative to the first rail 11 and second rail 10 according to a predetermined movement pattern. In the shown embodiment, the forced control device 22 includes a gear pivotally arranged on the first rail 11. The gear cooperates, on the one hand, with a tooth arrangement of the upper running carriage 16 and, on the other hand, with a tooth arrangement of the lower running carriage 16*a*. Alternatively, the forced control device 22 can include, as commonly known, a friction wheel cooperating, on the one hand, with a first running surface of the rail 9 and, on the other hand, with a second running surface of the second rail 10.

The invention claimed is:

1. A drawer pull-out guide, comprising:

a first rail and a second rail which are displaceable relative to one another;

a running carriage having a rolling body, wherein the running carriage is displaceably arranged between the first rail and the second rail over a travelling path;

a limiting element arranged on the first rail or on the second rail, the limiting element being configured to limit the travelling path of the running carriage;

a damping device arranged on the running carriage for dampening a movement of the running carriage over a damping path when the running carriage abuts against the limiting element, wherein a maximum damping path of the running carriage is predetermined; and a stop arranged on the first rail and a counterstop arranged on the second rail;

wherein the running carriage, the limiting element, the damping device, the stop, and the counterstop are configured such that, at a position corresponding to an end of the maximum damping path of the running carriage, the stop of the first rail and the counterstop of the second rail abut against each other and thereby stop a movement of the second rail relative to the first rail.

2. The drawer pull-out guide according to claim 1, wherein the damping device is arranged on a frontal end of the running carriage.

3. The drawer pull-out guide according to claim 1, wherein the damping device includes a spring tongue arranged on the running carriage, the spring tongue being configured so as to be reversibly bendable or reversibly deformable against a resilient action of the spring tongue when the running carriage abuts against the limiting element.

4. The drawer pull-out guide according to claim 3, wherein the spring tongue, together with the running carriage, has an integral one-piece construction.

5. The drawer pull-out guide according to claim 1, wherein the limiting element is arranged on a front end region or on a rear end region of the first rail or of the second rail.

6. The drawer pull-out guide according to claim 1, wherein the limiting element together with the first rail or the second rail, has an integral one-piece construction.

7. The drawer pull-out guide according to claim 1, wherein the limiting element is configured as a tab bent away from the first rail or from the second rail.

8. The drawer pull-out guide according to claim 1, wherein the first rail and the second rail are displaceably arranged between a closed position and an open position, and the stop of the first rail and the counterstop of the second rail are arranged to abut against each other in the open position.

9. The drawer pull-out guide according to claim 1, wherein a rail stop for stopping the rails, formed by the stop and the counterstop, is harder than a carriage stop for stopping the running carriage, the carriage stop being formed by the damping device and the limiting element.

10. The drawer pull-out guide according to claim 1, wherein the stop and the counterstop are each formed of a metallic material.

11. The drawer pull-out guide according to claim 1, wherein the drawer pull-out guide includes a forced control device for controlling a movement of the running carriage relative to a second running carriage, and/or for controlling a movement of the running carriage relative to the first rail and the second rail according to a predetermined movement pattern.

12. An item of furniture comprising:

a furniture carcass; and a drawer displaceable relative to the furniture carcass by the drawer pull-out guide according to claim 1, wherein the first rail is a carcass rail to be fixed to the furniture carcass, and the second rail is a drawer rail fixed to the drawer, the running carriage being displaceably arranged between the carcass rail and the drawer rail.

13. An item of furniture comprising:

a furniture carcass; and a drawer displaceable relative to the furniture carcass by the drawer pull-out guide according to claim 1, wherein the first rail is a carcass rail fixed to the furniture carcass, and the second rail is a central rail displaceably arranged between the carcass rail and a drawer rail fixed to the drawer, the running carriage being displaceably arranged between the carcass rail and the central rail.

14. An item of furniture comprising:

a furniture carcass; and a drawer displaceable relative to the furniture carcass by the drawer pull-out guide according to claim 1, wherein the second rail is a drawer rail fixed to the drawer, and the first rail is a central rail displaceably arranged between a carcass rail fixed to the furniture carcass and the drawer rail, the running carriage being displaceably arranged between the central rail and the drawer rail.

* * * * *